US006660697B2

(12) United States Patent
Dunn et al.

(10) Patent No.: US 6,660,697 B2
(45) Date of Patent: Dec. 9, 2003

(54) LUBRICATING OIL COMPOSITIONS

(75) Inventors: Adrian Dunn, Oxon (GB); Laurent Chambard, Oxfordshire (GB); Terence Garner, Oxon (GB)

(73) Assignee: Infineum International Ltd. (GB)

( * ) Notice: Subject to any disclaimer, the term of this patent is extended or adjusted under 35 U.S.C. 154(b) by 65 days.

(21) Appl. No.: 09/996,178

(22) Filed: Nov. 20, 2001

(65) Prior Publication Data

US 2002/0098992 A1 Jul. 25, 2002

(30) Foreign Application Priority Data

Nov. 27, 2000 (EP) ..... 00204222

(51) Int. Cl.[7] ..... C10M 159/20
(52) U.S. Cl. ..... 508/460; 508/586
(58) Field of Search ..... 508/460, 586

(56) References Cited

U.S. PATENT DOCUMENTS 5,792,735 A * 8/1998 Cook et al. ..... 508/452
5,942,476 A * 8/1999 Campbell ..... 508/574
6,103,672 A * 8/2000 Dunn et al. ..... 508/185
6,153,565 A * 11/2000 Skinner et al. ..... 508/391
6,159,912 A * 12/2000 McDonald ..... 508/395
6,277,794 B1 * 8/2001 Dunn ..... 508/199
6,281,179 B1 * 8/2001 Skinner et al. ..... 510/184
6,348,438 B1 * 2/2002 Le Coent et al. ..... 508/332

FOREIGN PATENT DOCUMENTS

EP 0 662 509 A2 7/1995 ..... C10M/159/22
EP 0 839 894 A1 5/1998 ..... C10M/163/00
EP 1 046 698 A1 10/2000 ..... C10M/163/00
WO WO97/46643 12/1997 ..... C10M/159/20

* cited by examiner

*Primary Examiner*—Jacqueline V. Howard

(57) ABSTRACT

A lubricating oil composition suitable for a trunk piston marine diesel engine. The lubricating oil composition comprises an admixture of:

(A) an oil of lubricating viscosity, in a major amount; and
(B) an oil-soluble complex overbased metal detergent additive, in a minor amount.

The composition is substantially dispersant-free or contains 1, or less than 1, preferably less than 0.5, mass % based on the mass of the compositions, of a dispersant. The composition has a TBN in the range of 3.5 to 100, preferably 8 to 100.

8 Claims, No Drawings

LUBRICATING OIL COMPOSITIONS

This invention relates to a lubricating oil composition suitable for a medium speed 4-stroke trunk piston compression-ignited (diesel) marine enigne.

The term "marine" does not restrict the engines to those used in water-borne vessels; as is understood in the art, it also includes those for auxiliary power generation applications and for main propulsion stationary land-based engines of the above types for power-generation.

Lubricating oil compositions (or lubricants) for trunk piston engines are known and may be referred to as trunk piston engine oils or TPEO's. They are known to include, as additives to improve their performance, ashless dispersants and overbased detergents.

EP-A-0-662 508 describes use of a composition that includes a hydrocarbyl-substituted phenate concentrate having a TBN greater than 300, and at least one of a hydrocarbyl-substituted salicylate and a hydrocarbyl-substituted sulphonate. Thee composition also includes a dispersant to minimise deposit formation in various parts of the engine.

EP-A-0-662 508 teaches the need for several additives, thus increasing cost in a cost-sensitive environment. It has now surprisingly been found that a dispersant-free or low dispersant TPEO, wherein the metal detergent is a complex detergent, provides excellent performance in the area of piston cleanliness.

Accordingly, a first aspect of the invention is a lubricating oil composition for a medium speed 4-stroke trunk piston compression-ignited (diesel) marine engine, comprising an admixture of:

(A) an oil of lubricating viscosity, in a major amount; and (B) an oil-soluble overbased metal detergent additive, in a minor amount, in the form of a complex wherein the basic material of the detergent is stabilised by more than one surfactant;

the composition being substantially dispersant-free or containing 1, or less than 1, preferably less than 0.5, mass % based on the mass of the compositions, of a dispersant; and the composition having a TBN in the range of 3.5 to 100, preferably 8 to 100.

A second aspect of the present invention is the use of additive (B) as defined in the first aspect of the invention in a lubricating oil composition that is dispersant-free or contains 1, or less than 1, preferably less than 0.5, mass % of a dispersant, to control piston undercrown deposits when the composition is used in a medium speed 4-stroke trunk piston compression-ignited marine engine.

A third aspect of the present invention is a method of lubricating a medium speed 4-stroke trunk piston compression-ignited marine engine which comprises supplying to the engine the lubricating oil composition according to the first aspect of the invention.

"Major amount" means in excess of 50 mass % of the composition.

"Minor amount" means less than 50 mass % of the composition, both in respect of the stated additive and in respect of the total mass % of all the additives present in the composition, reckoned as active ingredient of the additive or additives.

"Comprises or comprising" or cognate words is or are taken to specify the presence of stated features, steps, integers or components, but does not preclude the presence or addition of one or more other features, steps, integer components or groups thereof.

"TBN" (Total Base Number) is as measured by ASTM D2896, and the viscosity index is as defined by ASTM D2270.

The features of the invention will now be discussed in more detail below.

Marine Diesel Engines

The lubricating oil composition of the present invention may be suitable for use in a 4-stroke trunk piston engine having an engine speed of 200 to 2,000 e.g. 400 to 1,000, rpm, and a brake horse-power (BHP) per cylinder of 50 to 5,000 such as up to 3,000, preferably 100 to 2,000 or to 3,000.

Lubricating Oil Composition

The TBN of the lubricant composition is, as stated, in the range of from 3.5 to 100, preferably 8 to 100, and more preferably 10 to 60. Preferably, the viscosity index of the lubricant composition is at least 90, more preferably at least 95, and at most 140 such as 120, preferably 110. A preferred viscosity index range is from 95 to 115.

The lubricant composition may, for example, have a kinematic viscosity at 100° C. (as measured by ASTM D445) of at least 9, preferably at least 13, more preferably in the range of from 14 to 24, for example from 14 to 22, $mm^2s^{-1}$.

In use of the composition, it often becomes contaminated with fuel, such as residual fuel, in minor amounts, leading to cleanliness problems arising from presence of asphaltene components in the fuel. The present invention may alleviate the problem.

(A) Oil of Lubricating Viscosity

The oil of lubricating viscosity (sometimes referred to as lubricating oil) may be any oil suitable for the lubrication of a trunk piston engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tridecyl adipate, or polymeric hydrocarbon lubricating oils, for example liquid poly-isobutene and poly-alpha olefins. Commonly, a mineral oil is employed. The lubricating oil may generally comprise greater than 60, typically greater than 70, mass % of the composition, and typically have a kinematic viscosity at 100° C. of from 2 to 40, for example for 3 to 15, $mm^2s^{-1}$ and a viscosity index of from 80 to 100, for example from 90 to 95.

Another class of lubricating oils is hydrocracked oils, where the refining process further breaks down the middle and heavy distillate fractions in the presence of hydrogen at high temperatures and moderate pressures.

Hydrocracked oils typically have a kinematic viscosity at 100° C. of from 2 to 40, for example from 3 to 15, $mm^2s^{-1}$ and a viscosity index typically in the range of from 100 to 110, for example from 105 to 108.

The term 'brightstock' as used herein refers to base oils which are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, mass %, based on the mass of the composition.

The compositions are either totally free of dispersants, substantially free of dispersants or contain 1, or less than 1, preferably less than 0.5, mass % of dispersant. More preferably, the compositions include less than 0.4, more preferably less than 0.3, more preferably less than 0.2, even more preferably less than 0.1 and most preferably less than 0.01, mass % of dispersant. A dispersant is an additive for a lubricating composition whose primary function is to hold solid and liquid contaminants in suspension, thereby passivating them and reducing engine deposits at the same time as reducing sludge depositions. Thus, for example, a dispersant maintains in suspension oil-insoluble substances that result from oxidation during use of the lubricating oil, thus preventing sludge flocculation and precipitation or deposition on metal parts of the engine.

The composition preferably includes less than 0.015%, preferably less than 0.011%, more preferably less than 0.007%, even more preferably less than 0.004%, and most preferably less than 0.0004%, by mass of nitrogen.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

(B) Complex Overbased Metal Detergent

A detergent is an additive that reduces formation of piston deposits, for example high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants.

The detergent comprises a polar head with a long hydrophobic tail, the polar head comprises a metal salt of the acid in compound. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle. The overbased detergents of this invention may have a TBN in the range of 200 to 500, preferably 250 to 400.

As stated, the detergent is in the form of a complex wherein the basic material is stabilised by more than one surfactant. Thus, complexes are distinguished from mixtures of two or more separate overbased detergents, an example of such a mixture being one of an overbased salicylate detergent with an overbased phenate detergent.

The art describes examples of overbased complex detergents. For example, International Patent Application Publication Nos 97/6643/4/5/6 and 7 describe hybrid complexes made by neutralising a mixture of more than one acidic organic compound with a basic metal compound, and then overbasing. Individual basic micelles of the detergent are thus stabilised by a plurality of surfactants.

EP-A-0 750 659 describes a calcium salicylate phenate complex made by carboxylating a calcium phenate and then sulfurising and overbasing the mixture of calcium salicylate and calcium phenate. Such complexes may be referred to as "phenalates".

The metal may be an alkali or alkaline earth metal, e.g., sodium, potassium, lithium, calcium, and magnesium. Calcium is preferred.

Surfactants that may be used include organic carboxylates, such as salicylates, non-sulfurised or sulfurised; sulfonates; phenates, non-sulfurised or sulfurised; thiophosphonates; and naphthenates. For example, the surfactants may be salicylate and phenate.

Surfactants for the surfactant system of the overbased metal detergent may contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility.

The complex detergent may be used in a proportion in the range of 0.1 to 30, preferably 2 to 15 or to 20, mass % based on the mass of the lubricating oil composition.

Other additives, such as known in the art, may be incorporated into the lubricating oil compositions of the invention. They may, for example, include other overbased metal detergents that are not complex detergents, for example alkaline earth metal (eg Ca or Mg) phenates or salicylates; anti-wear agents; anti-oxidants; pour point depressants; anti-foamants; and/or demulsifiers. Of these, anti-wear additives will be described in further detail as follows:

Antiwear Additives

Dihydrocarbly dithiophosphate metal salts constitute a known class of anti-wear additive. The metal in the dihydrocarbyl dithiophosphate metal may be an alkali or alkaline earth metal, or aluminium, lead, tin, molybdenum, manganese, nickel or copper. Zinc salts are preferred, preferably in the range of 0.1 to 1.5, preferably 0.5 to 1.3, mass %, based upon the total mass of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary in character and hydrocarbyl groups that are entirely primary in character. To make the zinc salt, any basic or neutral zinc compound may be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil-soluble salts of dihydrocarbyl dithiophosphoric acids and may be represented by the following formula:

$$[(RO)(R^1O)P(S)S]_2Zn$$

where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, I-propyl, n-butyl, 1-butyl, sec-butyl, amyl, n-hexyl, 1-hexyl, n-octyl, decyl, dodecyl, octadecyl, 2-ethylehexyl, phenyl, butylphenyl, cyclohexyl, methylcyclopentyl, propenyl, butenyl. In order to obtain oil-solubility, the total number of carbon atoms (i.e. in R and $R^1$) in the dithiophoshoric acid will generally be 5 or greater. The zinc dihydrocarbyl dithiophosphate can therefore comprise zinc dialkyl dithiophosphates.

It may be desirable, although not essential, to prepare one or more additive packages or concentrates comprising the additive or additives, whereby additive (B) and other additives, if to be provided, can be added simultaneously to the oil of lubricating viscosity (or base oil) to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant. Thus, additive (B) and others, if to be provided, may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive packages(s), the remainder being base oil.

The term 'active ingredient' (a.i.) as used herein refers to the additive material that is not diluent.

The terms 'oil-soluble' or 'oil-dispersable' as used herein do not necessarily indicate that the compounds or additives are soluble, dissolvable, miscible or capable of being suspended in the base oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined individual (i.e. separate) components that may or may not remain the same chemically before and after mixing.

EXAMPLES

The following examples illustrate, but in no way limit, the invention.

Components

The components used in the examples were as follows:

Overbased Metal Detergents

B1—a calcium salicylate having a TBN of 168

B2—a calcium salicylate having a TBN of 280

B3—a calcium salicylate having a TBN of 300

B4—a calcium phenate having a TBN of 250

B5—a calcium salicylate/phenate complex having a TBN of 270 made by sulfurising and then overbasing a mixture of calcium salicylate and calcium phenate, eg as described in EP-A-750 659

B6—a calcium salicylate/phenate hybrid complex having a TBN of 325 made by overbasing a mixture of a salicylic acid, a phenol and a basic calcium compound, eg as described in International Patent Application Publication Nos 9746643/4/5/6 and 7.

Dispersant

D—a polyisobutene succinimide

Lubricant Composition and Tests

Lubricant compositions, as trunk piston marine diesel lubricating oils, were prepared by admixing with a basestock one or more of the components B1 to B6 and optionally the dispersant (D). The admixing was carried out at elevated temperature. Four compositions were prepared, two (Oils 1 and 2) being oils of the invention, and two (Reference Oils 1 and 2) being for comparison. Reference Oil 3, a commercially-available trunk piston marine diesel lubricating oil, was also tested for comparison purposes. All five oils had a TBN of 30; they comprised the following additives, where a tick indicates the pressence of the additive:

| OIL | B1 | B2 | B3 | B4 | B5* | B6* | D |
|---|---|---|---|---|---|---|---|
| Oil 1 | | | ✓ | | | ✓ | |
| Oil 2 | | | | | | ✓ | |
| Reference Oil 1 | ✓ | | | ✓ | | | |
| Reference Oil 2 | ✓ | ✓ | | ✓ | | | |
| Reference Oil 3 | | | | | ✓ | | ✓ |

D, when present, exceeded 1 mass % of the oil,
*indicates a complex detergent.
Each oil contained other additive components such as described herein.

Each oil was tested by using it to lubricate a laboratory single-cylinder Caterpillar/AVL 1Y540 test engine, operating on heavy fuel, and run for 96 hours at constant speed and load conditions (1400 rpm, BMEP 18.2 bar). At the end of the test, the piston of the engine was disassembled and rated visually according to the CRC rating procedure described in the CRC Manual No. 18 (1991), Chapter V entitled "Modified CRC Diesel Piston Rating Method".

Each oil was rated for the cleanliness of the piston undercrown. This area is particularly prone to accumulate deposits, and hence is of particular and important interest in evaluating lubricant performance. After each test, the piston was cleaned, reassembled into the engine, and the engine flushed with solvent.

Results

The table below summarises the results, expressed as weighted demerits. Lower values indicate a superior performance.

| OIL | UNDERCROWN |
|---|---|
| Oil 1 | 108.4 |
| Oil 2 | 114.1 |
| Reference Oil 1 | 192 |
| Reference Oil 2 | 193.5* (std: 9.19) |
| Reference Oil 3 | 235.9 |

*Average of three tests. All others are single test results.

The results demonstrate the superiority of both oils of the invention in the piston undercrown area.

What is claimed is:

1. A lubricating oil composition for a 4-stroke trunk piston medium speed compression-ignited marine engine, comprising an admixture of:

(A) an oil of lubricating viscosity, in a major amount; and (B) an oil-soluble overbased metal detergent additive, in a minor amount, in the form of a complex wherein the basic material of the detergent is stabilised by more than one surfactant;

the composition containing less than 1 mass %, based on the mass of the composition, of a dispersant; and the composition having a TBN in the range of 8 to 100.

2. The composition as claimed in claim 1, wherein in (B) at least one of the surfactants is a salicylate.

3. The composition as claimed in claim 2, wherein in (B) another of the surfactants is a phenate.

4. The composition as claimed in claim 1, wherein in (B) the metal detergent is a calcium detergent.

5. The composition as claimed in claim 4, further comprising a fuel oil with a residual fuel content, in a minor amount.

6. A method of lubricating a medium-speed 4-stroke trunk piston compression-ignited marine engine which comprises supplying to the engine the lubricating oil composition as claimed in claim 1.

7. The composition of claim 1 wherein said composition contains less than 0.5 mass %, based on the mass of the composition, of dispersant.

8. The composition of claim 1, wherein said composition has a TBN in the range of 10 to 100.

* * * * *